US010688547B2

(12) United States Patent
Toschi

(10) Patent No.: US 10,688,547 B2
(45) Date of Patent: Jun. 23, 2020

(54) BRAKING SYSTEM FOR DECELERATING LONG PRODUCTS, SUCH AS BARS, EXITING FROM A ROLLING MILL CONFIGURED TO MANUFACTURE SAID LONG PRODUCTS AND METHOD TO OPERATE THE SAME

(71) Applicant: Primetals Technologies Italy S.R.L., Marnate (VA) (IT)

(72) Inventor: Francesco Toschi, Legnano (IT)

(73) Assignee: PRIMETALS TECHNOLOGIES ITALY S.R.L. (IT)

( * ) Notice: Subject to any disclaimer, the term of this patent is extended or adjusted under 35 U.S.C. 154(b) by 452 days.

(21) Appl. No.: 15/540,140

(22) PCT Filed: Dec. 23, 2015

(86) PCT No.: PCT/EP2015/081126

§ 371 (c)(1),
(2) Date: Jun. 27, 2017

(87) PCT Pub. No.: WO2016/119983

PCT Pub. Date: Aug. 4, 2016

(65) Prior Publication Data

US 2018/0015516 A1 Jan. 18, 2018

(30) Foreign Application Priority Data

Jan. 30, 2015 (EP) ..... 15425005

(51) Int. Cl.
*B21B 39/02* (2006.01)
*B21B 39/08* (2006.01)
(Continued)

(52) U.S. Cl.
CPC ..... *B21B 39/086* (2013.01); *B21B 1/16* (2013.01); *B21B 43/003* (2013.01)

(58) Field of Classification Search
CPC ..... B21B 39/086; B21B 39/02; B21B 39/08
(Continued)

(56) References Cited

U.S. PATENT DOCUMENTS 2,328,860 A * 9/1943 Taylor ..... B65G 47/00 198/690.1
3,016,772 A 1/1962 Lloyd
(Continued)

FOREIGN PATENT DOCUMENTS

CN 104190707 A 12/2014
DE 30 17 717 A1 1/1981
(Continued)

OTHER PUBLICATIONS

US 2007/0125182 A1, Jun. 7, Garshelis et al. (Year: 2007).*
(Continued)

*Primary Examiner* — Douglas A Hess
(74) *Attorney, Agent, or Firm* — Ostrolenk Faber LLP

(57) ABSTRACT

A contactless braking system and a related method for decelerating long products (bi) exiting from a rolling mill (100). At least one braking module (6) includes a multiplicity of electromagnets (60) in a series along a braking line (1*b*). Each magnet has an open magnetic core (61) and a coil (62) around the magnetic core (61). The open magnetic core (61) has a gap formed by two opposed poles. The electromagnets (60) are configured so that the gap of each open magnetic core (61) lets contactlessly slide therethrough each long product (bi) exiting from the rolling mill (100). A braking magnetic force (Fd) is exerted on the long product (bi) contactlessly sliding through the gap. The braking magnetic force (Fd) is opposite to the direction of movement of the long product (bi) exiting the rolling mill (100).

13 Claims, 6 Drawing Sheets

(51) Int. Cl.
*B21B 1/16* (2006.01)
*B21B 43/00* (2006.01)

(58) Field of Classification Search
USPC ..... 198/805; 72/227, 231
See application file for complete search history.

(56) References Cited

U.S. PATENT DOCUMENTS 3,304,084 A * 2/1967 Ashton ..... B21B 39/002 271/193
4,722,214 A * 2/1988 Hayashi ..... B21D 5/04 72/319
5,388,526 A * 2/1995 Imai ..... B65G 54/025 104/118
5,402,021 A * 3/1995 Johnson ..... B65G 54/02 198/619
6,074,329 A * 6/2000 Hirano ..... G05B 19/41815 198/346.1
6,373,017 B1 * 4/2002 Isoyama ..... B21B 15/0085 219/57

FOREIGN PATENT DOCUMENTS

| | | | |
|---|---|---|---|
| DE | 31 06 897 | A1 | 9/1982 |
| GB | 1056375 | | 1/1967 |
| JP | S48-41465 | A | 6/1973 |
| JP | S49-67861 | A | 7/1974 |
| JP | S52-7363 | A | 1/1977 |
| JP | 2014-160733 | A | 9/2014 |
| SU | 791575 | | 12/1980 |
| WO | WO 2010/038910 | A2 | 4/2010 |

OTHER PUBLICATIONS

International Search Report dated Mar. 17, 2016 in corresponding PCT International Application No. PCT/EP2015/081126.
Written Opinion dated Mar. 17, 2016 in corresponding PCT International Application No. PCT/EP2015/081126.
Japanese Office Action, dated Dec. 3, 2018, issued in corresponding Japanese Patent Application No. 2017-540122. English translation. Total pp. 4.
Office Action dated Oct. 17, 2019, issued in corresponding Russian Patent Application No. 2017130259/14 (052692) with English translation.

* cited by examiner

PRIOR ART

PRIOR ART

BRAKING SYSTEM FOR DECELERATING LONG PRODUCTS, SUCH AS BARS, EXITING FROM A ROLLING MILL CONFIGURED TO MANUFACTURE SAID LONG PRODUCTS AND METHOD TO OPERATE THE SAME

CROSS-REFERENCE TO RELATED APPLICATIONS

The present application is a 35 U.S.C. §§ 371 national phase conversion of PCT/EP2015/081126, filed Dec. 23, 2015, which claims priority of European Patent Application No. 15425005.4, filed Jan. 30, 2015, the contents of which are incorporated by reference herein. The PCT International Application was published in the English language The present invention relates to a method and a system for decelerating long products, such as bars, rods or the like, exiting from a rolling mill configured to manufacture the long products, and particularly relates to a method and a system for contactlessly braking such long products.

TECHNICAL BACKGROUND

Long metal products are generally produced in a plant using a succession of steps. Normally, in a first step, metallic scrap is provided as feed material to a furnace, which heats the scrap liquid status. Afterwards, continuous casting equipment is used to cool and solidify the liquid metal and to form a suitably sized metal strand. Such a strand may then be cut to produce a suitably sized intermediate long product, typically a billet or a bloom, to create feed stock for a rolling mill. Normally, such feed stock is then cooled in cooling beds. Thereafter, a rolling mill is used to transform the feed stock, otherwise called billet or bloom depending on dimensions, to a final long product, for instance rebars or rods in straight products or coils, available in different sizes, which can be used in mechanical or construction industry. To obtain this result, the feed stock is pre-heated to a temperature which is suitable for its entering the rolling mill so as to be rolled by rolling mill equipment including multiple rolling stands. During rolling through these multiple stands, the feed stock is reduced to the desired cross section and shape. The long product resulting from the former rolling process is normally cut when it is still in a hot or warm condition, typically between 500 and 980° C.; cooled in a cooling bed; and finally cut at a commercial length, typically between 12 and 24 m, and packed to be ready for delivery to the customer in bundles of 1 to 5 tons.

All long metal products obtained by continuous casting and rolling exit the rolling mill with a certain speed and length. They generally need to be cut and then decelerated when advancing along a delivery path which ends with a cooling bed where the long metal products are stored for further processing and/or packaging.

For instance, hot rolled steel ribbed bars or rebars, which are typically used for concrete reinforcement. After the last rolling pass of so called high speed rolling mills, the hot rolled steel is quenched to about 500 to 600° C. and is cut to a defined length that typically is around 90 m to 120 m. From a 12 m long billet with a weight of 2 tons, a bar with a length of more than 3000 m can be generated. The speed of the steel at the rolling mill exit is normally about 30 to 50 m/s. After cutting, the bars need to be suitably braked in order to allow their unloading onto cooling beds. The bars so produced need to reach the cooling beds preferably at a speed which is close to 0.

In view of the above facts, one major technical challenge is to brake the bars from 30 m/s and above at the exit from the rolling mills to a speed suitable for unloading on cooling beds, such as for instance to 2 m/s, in the shortest time.

Current technologies perform braking of bars or, in general, of long products by motorized rotating rolls that clamp the bar to mechanically decelerate it. Magnetic equipment for braking the bar by friction between magnets and the bar itself has also been used.

According to these existing technologies, long products such as bars are pinched between two rotating rolls that, by closing on each bar for instance via a pneumatic cylinder, brake the bar. The contact pressure on the bars' surface and the friction coefficient generate a braking force on the bars.

The rotating rolls are usually mechanically connected to electric motors for the deceleration. Typical installed power is 400 to 800 kW distributed in 2 to 4 motors which are independently driven.

Due to the deformability of long products such as the above bars at temperatures that, immediately at the exit of the last rolling stand, are still around 600° C. on average, the pressure exerted by the rotating rolls for braking can result in an unacceptable deformation of the long product to the point of altering the shape of its cross section.

In order to limit the above undesirable product damage side effects caused by braking using pinch-rolls according to the state of the art, the pinching force generated by the pneumatic cylinder may be limited.

However, compromising on pinching force decreases the friction coefficient between the bar and rolls and, consequently, the transmittable torque is reduced. Reducing the applied torque diminishes the braking force and accordingly diminishes the performance of the system which is thereby limited.

Increasing the number of braking rolls, or pinch-rolls, is not cost-effective because the overall cost for equipment increases with the number of braking rolls employed, at least because more roll driving means would also be required. Under these conditions, the typical installation space necessary to receive a braking unit according to the prior art is 5 to 10 m in length.

In addition to the disadvantageous way of regulating the braking force, the technologies currently employed for braking long products exiting rolling mills have a further drawback associated with the mechanical connections between pinch-rolls and then actuating means. In practice, the response time of a braking system based on pinch-rolls is low and the order of magnitude of the resulting braking cycle is of at least 1 second.

None of the existing plants for production of long metal products by continuous casting and rolling processes manages to decelerate the long products exiting the rolling mill and to deliver them to a cooling bed, while at the same time guaranteeing that the shape and mechanical properties of the long products remain unchanged, without compromising the effectiveness of the braking effect.

Moreover, none of the existing solutions for decelerating long metal products on leaving the last rolling mill stand is specifically designed to effectively take into account at the same time the throughput, that is, the rate at which the long metal products are manufactured and ejected from the rolling mill;

the space constraints with which the plant layout design ideally complies;

the costs of operating a manufacturing plant for continuous casting and rolling of long products provided with a relative braking system allowing storing such long products on cooling beds;

the product quality in terms of shape and technological properties.

Thus, a need exists in the prior art for a method, and a corresponding system, for decelerating long products exiting from a rolling mill, such as bars, which preserves unaltered the shape and functional characteristics of such long products that result from the rolling process, while concurrently efficiently coping with the related throughput rates and with the speed at which the long products leave the rolling mills.

A need exists in the prior art also for a method, and a corresponding system, for decelerating long products exiting a rolling mill, such as bars, which guarantees a reduction in the spaces required for arresting and then packaging such long products, while allowing costs linked to equipment and machinery.

SUMMARY OF THE INVENTION

Accordingly, a major object of the present invention is to provide a method and a corresponding plant for decelerating long products exiting a rolling mill which allows:

effective braking of rolled long products from their exit speed at the last rolling stand to a speed compatible with discharging them on cooling beds; and, at the same time, offers the advantage accomplishing the above braking operation in the shortest time and within the shortest spaces, and to effectively brake the rolled long product without touching the bar and without applying force directly onto the bar.

A rolling mill plant which is equipped with a system according to the present invention can manage rolling mill product throughput traveling at high speeds, such as 30 m/s and above, and can substantially arrest such products in a conveniently short space without touching the bar.

A companion object of the present invention is to allow braking of long products exiting a rolling mill without running the risk of generally damaging such products, for instance by leaving permanent dents or marks on them or altering the shape of the cross section obtained by the rolling process.

By adopting a contactless braking technique, such as the present invention, any risk of damage to the products in connection with deceleration and unloading on the cooling beds can be advantageously avoided. To achieve these results by contactless braking, it is preferred that the metal rolling mill product being braked as it exits the rolling be a long product, long enough to be effectively braked. In this rolling mill operating at a selected speed, the long metal product may be more than one meter in length.

Further, the design of the braking system according to the present invention allows avoiding use of bulky driving means and transmission means, which normally take up a lot of physical space and absorb a considerable amount of energy. Accordingly, the braking system according to the present invention advantageously helps reduce global production costs because less power is thus needed, in compliance with increasingly relevant energy saving measures and ecological requirements.

The present invention achieves these and other objectives and advantages by the features of a system and a method according to the invention.

BRIEF DESCRIPTION OF THE DRAWINGS

Other objectives, features and advantages of the present invention will be now described in greater detail with reference to specific embodiments represented in the attached drawings, wherein.

v is the bar speed

F is the braking force

Figure 1A:
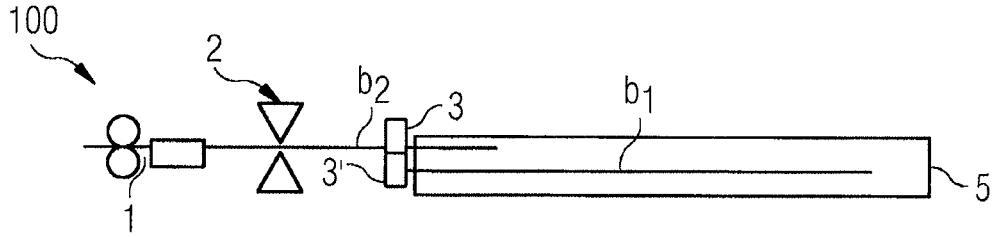
FIGS. 1A, B, C and D are a schematic, general view of several phases of operation of a prior art production plant comprising rolling mill stands and shears, for instance in a single strand rolling mill as portrayed. The several phases of a braking cycle according to existing, prior art braking solutions are sequentially represented in FIGS. 1A, B, C and D.

B is the magnetic field.

DESCRIPTION OF EMBODIMENTS

In the figures, like reference numerals depict like elements.

Figure 1B:
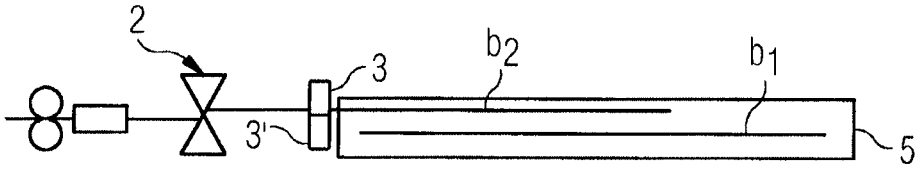
PRIOR ART FIG 1B
Figure 1C:
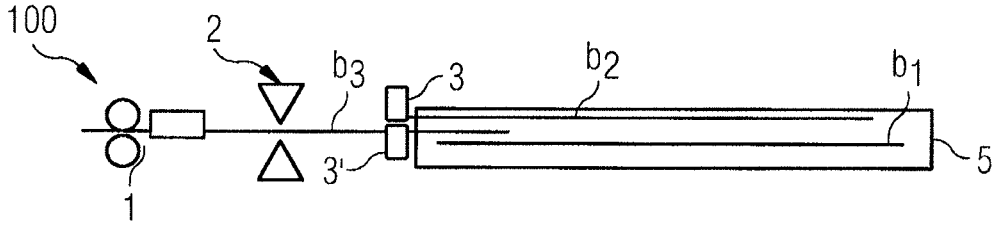
PRIOR ART FIG 1C
Figure 1D:
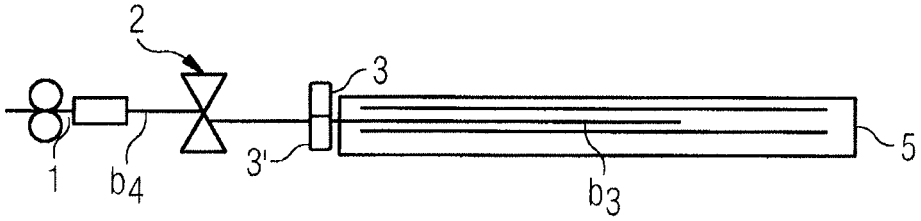
PRIOR ART FIG 1D
Figure 2:
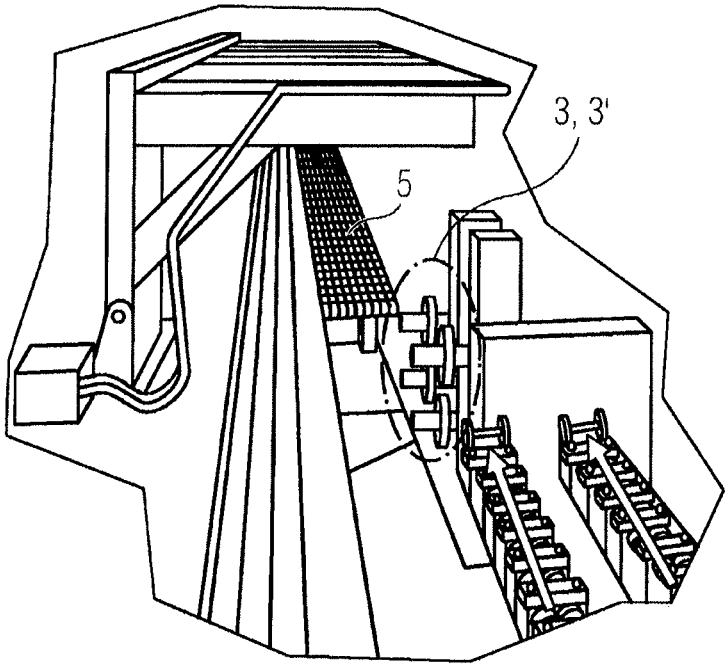
FIG. 2 is a view of a specific braking unit according to the prior art, highlighting the overall bulkiness and the typically considerable installation space occupied by existing long product braking solutions.

FIGS. 1 and 2 further clarify drawbacks of the systems currently used in the prior art for decelerating long products exiting from a rolling mill. For example, a single strand rolling mill typically operates by using a conventional double strand braking system for decelerating the produced long products, metal products which are affected by magnetic forces, such as steel, wherein the products are in a form such as bars, to allow storage thereof on a cooling bed. A single strand rolling mill 100 normally comprises rolling stands 1 and shears 2 to cut the strands or the intermediate long products in general into the desired, required final cooling bed length.

A standard braking cycle according to a so called double strand braking system comprises a sequence of steps wherein, with reference to the illustrations of FIG. 1, from top to bottom:

in a first step in FIG. 1A, a first long product, such as bar $b_1$, is finally braked by a brake 3' and is successively discharged onto a cooling bed 5; while in a second step in FIG. 1B, which happens in parallel to the above first step, a second long product, such as bar $b_2$, passes through brake 3 which brake is not yet power-driven and is not actively exerting a braking force on bar $b_2$, through its pinch-rolls which remain open at this stage;

in a third step in FIG. 10, when bar $b_2$ is cut by shear 2, brake 3 is power-driven and actively exerts a braking force on bar $b_2$ through its pinch-rolls which remain at this stage closed for the time necessary to decelerate the bar $b_2$ from a rolling speed down to typically 3 m/s;

in a fourth step in FIG. 1D, the brake 3 stops actively operating a braking action on bar 2 which is ready to be eventually discharged onto the cooling bed 5 like former bar $b_1$ was; whereas a further third long product, such as bar $b_3$, is let pass to a not-yet powered brake 3', to be braked by the same brake 3' once the shear 2 has operated the cut on bar $b_3$.

Analogously to the cycle already described, a fourth bar $b_4$ follows and is directed to brake 3 and the cycle is repeated alternatively for bars $b_3$ and $b_4$.

The brakes 3 and 3' of FIG. 1 generally do not work together in such a conventional double strand braking system. A typical braking cycle for a 96 m long bar running at 50 m/s comprise the following phases:

braking ON time: 0.94 seconds; braking OFF time: 2 seconds.

FIG. 2 shows how the space typically occupied by a conventional braking unit comprising pinch rolls as described is in a range between 5-10 meters.

Eddy current brakes are known in the prior art which rely on the electromagnetic drag force between a magnet and a nearby conductor in relative motion, such drag force being due to eddy currents induced in the conductor through electromagnetic induction.

Currently, eddy current brakes are used to slow high-speed trains or roller coasters, to promptly stop powered tools when power is turned off, or in electric meters and switches used by electric utilities. Eddy current rail brakes are for instance disclosed in WO 2010/038910 A2.

No application is known in the prior art which allows employment of eddy currents for decelerating long products, such as bars, exiting a rolling mill configured to manufacture such long products.

Figure 3A:
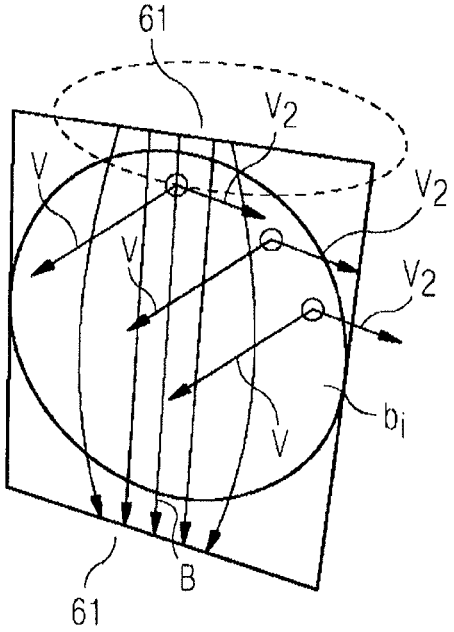
FIG. 3A is a schematic representation of how an electromagnet according to the present invention comes to exert a dragging force on a moving, metal long product such as a product produced by rolling mills in a long rolling process.
Figure 3B:
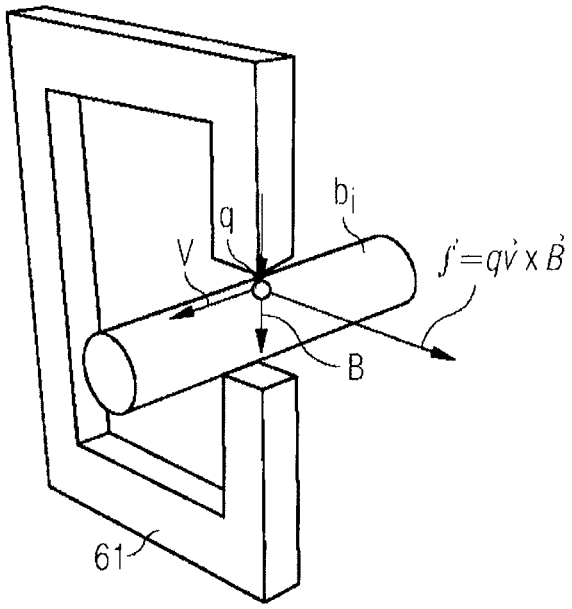
FIG. 3B is a schematic perspective view of an electromagnet to be arranged in a series along a braking line according to the present invention, wherein an open magnetic core of the electromagnet comprises a gap formed by two opposed poles between which a magnetic field flows to let a long product contactlessly slide therethrough as it exits a rolling mill.
Figure 3C:
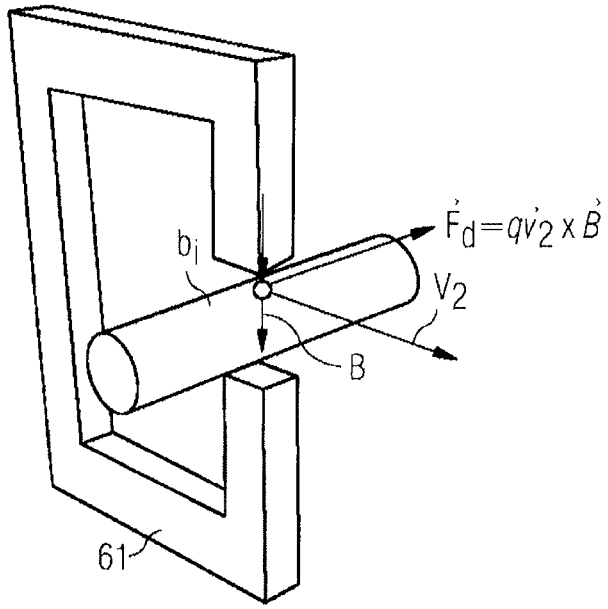
FIG. 3C is a schematic perspective view of the electromagnet of FIG. 3B, wherein it is highlighted how, based on eddy currents, a dragging force reacting back on the source of magnetic field change is generated which exerts a braking action opposite to the movement of the long product of FIG. 3B.

The system and the method according to the present invention advantageously apply to the field of long rolling, particularly to the task of decelerating long rolled products, such as bars, the fact that a conductive surface moving past a stationary magnet will have circular electric currents, i.e. eddy currents, induced in it by the relative magnetic field, based on Faraday's law of induction. FIGS. 3A, 3B and 3C schematically portray the creation of eddy currents flowing at speed v2 on a conductive surface of a long product, such as a bar $b_1$, in the sense of the present application. Such eddy currents result from the movement, of the long product $b_1$ at its own speed v through an electromagnet 60 according to the present invention. As a consequence of the movement of the conductor and long product $b_1$ through an electromagnet 60, the charges q on the conductor and long product $b_1$ present a force f (vectorially indicated in FIG. 3B as $\vec{f}=q\vec{v}\times\vec{B}$) which is at the origin of said eddy currents.

According to Lenz's law, the circulating eddy currents will create their own magnetic field which opposes the field B of the magnet 60. Thus a moving conductor, such as a long product $b_1$ manufactured by long rolling, will experience a drag force Fd from the magnet 60 opposing its motion. Such drag force Fd (vectorially indicated in FIG. 3C as $\vec{F}_d=q\vec{v}_2\times\vec{B}$) will be proportional to the field B of the electromagnet 60 and, ultimately, to the velocity or speed v of movement of the long product $b_1$.

The rolling product is long enough so that in consideration of its speed at exiting the rolling mill and the eddy currents generated as the metal product contactlessly passes through the gap, the rolling product is long enough to be contactlessly braked. In a preferred embodiment, the metal product is long, being at least one meter in length.

Figure 4:
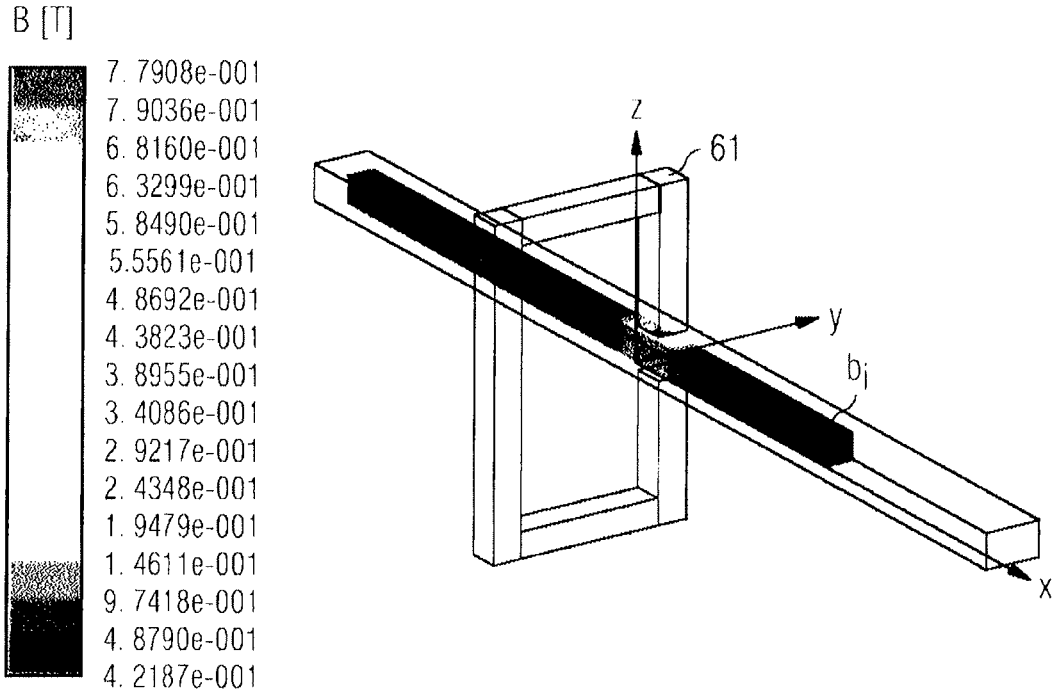
FIG. 4 is a schematic perspective view of an electromagnet according to the present invention, such as the one of FIGS. 3B and 3C, wherein the braking effect created is put in correlation with the magnetic field created by the electromagnet in a FEM modelization.
Figure 5:
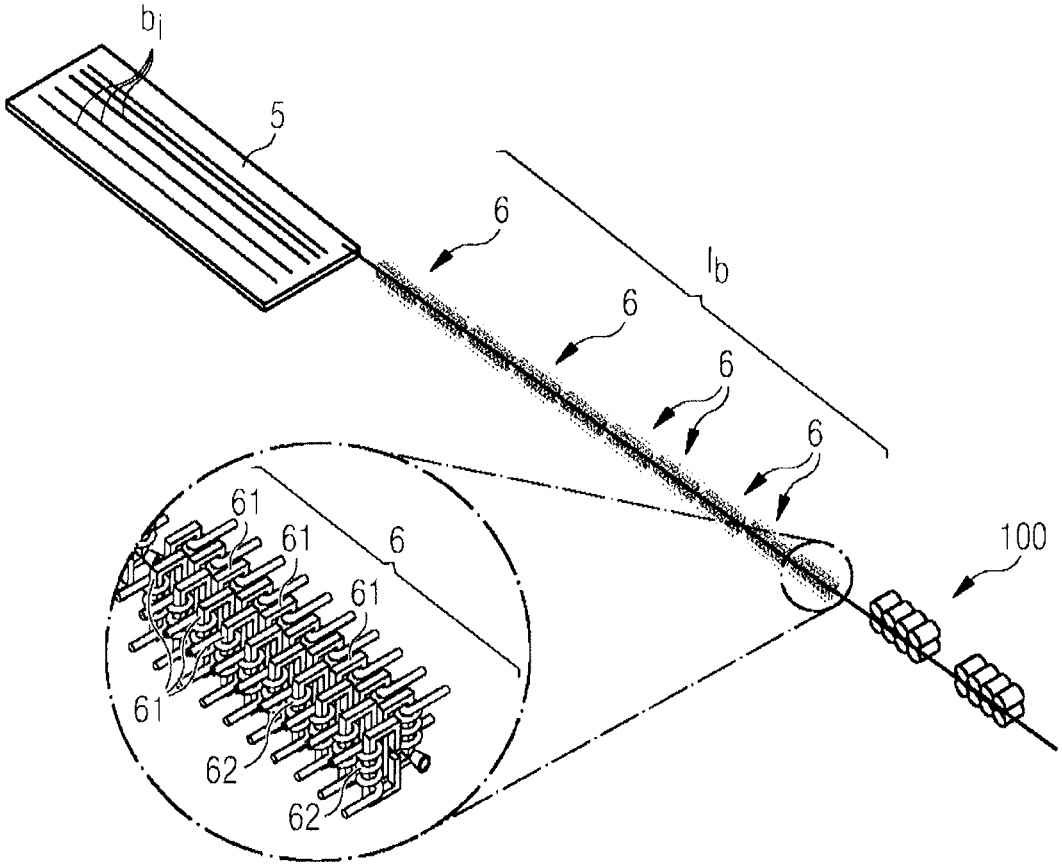
FIG. 5 is a schematic view of a long rolling plant comprising a contactless braking system for decelerating long products, such as bars, according to the present invention.

In light of the teachings exemplified in FIGS. 3A-3C and with reference to FIGS. 4 and 5, a contactless braking system for decelerating long products, such as bars $b_1$, exiting a rolling mill 100 configured to manufacture the long products comprises at least one braking module 6. Such braking module 6 comprises a multiplicity of electromagnets 60 arranged in a series along a braking line 1*b*.

Figure 6:
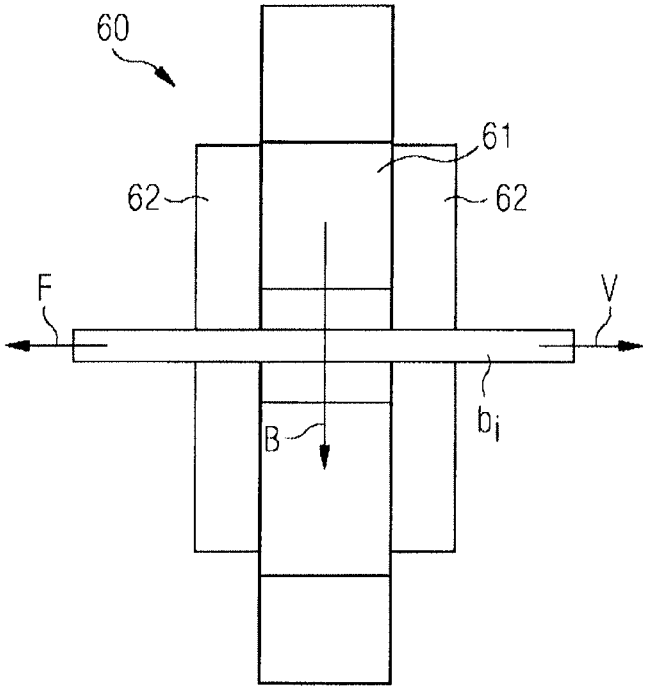
FIG. 6 and FIG. 7 are, respectively, schematic front and side views of the electromagnet of FIG. 3B or of FIG. 3C, wherein the coil surrounding the magnetic core of the electromagnet is further represented where.
Figure 7:
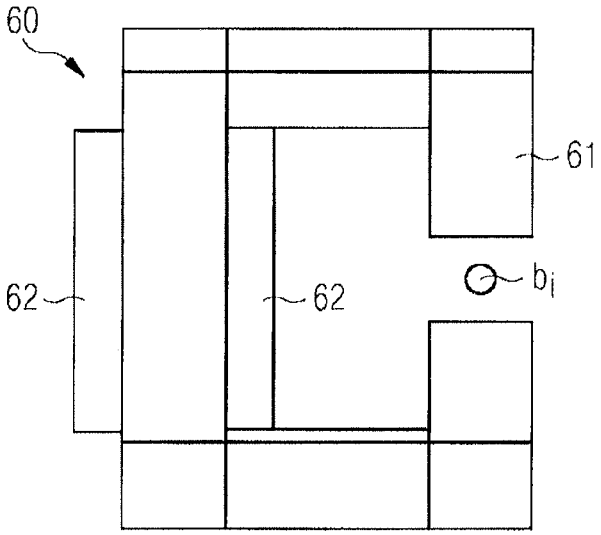

Each of the electromagnets 60 is configured to induce a magnetic field B. It comprises an open magnetic core 61 and a coil 62 wound around the magnetic core 61, as for instance represented in FIGS. 5, 6 and 7. The wires of the coil 62 are connected to a power supply, and a current runs in the coil 62, thus producing the magnetic field B.

The magnetic core 61 can be a C-type magnetic core or it can be generally yoke-shaped. More specifically, the open magnetic core 61 comprises a gap formed by two opposed poles between which the magnetic field B flows. In an embodiment wherein the magnetic core is C-shaped, for instance, the magnetic field B loops on the core across the gap. The electromagnets 60 are configured in a way that the gap of each open magnetic core 61 is apt to receive each long product $b_1$ and let it contactlessly slide $b_1$ the core through when exiting a rolling mill 100, as exemplified in FIGS. 3*b*, 3*c* and 4.

When a long product, such as a bar $b_1$, contactlessly slides through the gap of the magnetic core 61, a braking magnetic force, or drag force, Fd is exercised on the long product $b_1$ by the electromagnets 60. The braking magnetic force Fd is opposite to the direction of movement of the long product $b_1$ exiting the rolling mill 100.

In one possible, favorite embodiment, the contactless braking system according to the present invention comprises a multiplicity of braking modules 6 arranged in series with respect to each other along a braking line 1*b*, for instance as portrayed in FIG. 5.

The braking line 1*b* is positioned and extends between the exit of a rolling mill 100 and a cooling bed 5 to which the product of the long rolling process, such as bars $b_1$, can be delivered, to be subsequently thereon discharged. The braking system can also be installed directly onto the cooling bed since no motor is directly connected and only power cables are connected with the power supply.

As is apparent in the enlarged view of detail a of FIG. 5, in a favorite, but not exclusive, configuration of braking modules 6, the electromagnets 60 can advantageously be staggered along the braking line 1*b* according to a first row and to a second row so as to form an alternate arrangement with each other along the braking line 1*b*.

In particular, the electromagnets 60 of the first row and the electromagnets 60 of the second row can also be offset from each other in a direction transverse to the braking line 1*b*, so that the full sequence of the gaps formed by the two opposed poles of each electromagnet's core 61 are lined up.

Because of such an arrangement, the contactless passage of a long product $b_1$ through the gaps of the series of electromagnets 60 is enabled.

Other, modified and specific arrangements of the series of electromagnets 60 are possible, compatible with the substantially contactless passage of long products $b_1$ through the gaps of the series of electromagnets 60 and the achievement of creating an overall magnetic braking force, or drag force, Fd. In general, in the contactless braking system for decelerating long products $b_1$ according to the present invention, the resulting overall magnetic braking force Fd, or drag force, preferably represents the sum of the braking magnetic forces developed by each electromagnet 60.

The two opposed poles of each open magnetic core 61 between which the magnetic field B flows advantageously have an active surface whose extension and shape are dependent on the general physical characteristics and dimensions of the long products $b_1$ manufactured. The active surface of such poles can preferably be in a wide range of 60 to 1000 square millimeters. Analogously, the gap distance between the two poles can vary within a wide range in relation to the final products, for instance the gap can be of 10 to 60 millimeters.

The number of electromagnets 60 can also vary and depend on the required plant performance and on the characteristics of the manufactured products. The number of electromagnets 60 can preferably be between 20 to 400.

Analogously, the present application also relates to a method of contactlessly decelerating long products, such as bars, exiting a rolling mill configured to manufacture such long products.

A method of contactlessly decelerating long products according to the present invention comprises a step of arranging at least a braking module 6 comprising a multiplicity of electromagnets 60 in a series along a braking line 1*b*, wherein the braking line 1*b* is positioned between the exit of a rolling mill 100 and a cooling bed 5 for the long products $b_1$.

The electromagnets used for carrying out the related operations are structured as above described, that is each of the electromagnets 60 comprises an open magnetic core 61 and a coil 62 around the magnetic core 61. The open magnetic core 61 comprises a gap formed by two opposed poles.

The method according to the present invention comprises a step of each of the electromagnets 60 inducing a magnetic field B flowing across the gap, which is achieved by powering the coils 62.

Subsequently, the method according to the present invention comprises a step of feeding the long products $b_1$ exiting the rolling mill 100 to the at least one braking module 6 by letting the long products $b_1$ contactlessly slide through each of the gaps of respective open magnetic cores 61. By proceeding as above, the method according to the present invention ensures that a braking magnetic force, or drag force, Fd is applied on the long products $b_1$ by the electromagnets 60 while the long products $b_1$ contactlessly slide through the gaps. As explained, the braking magnetic force Fd is opposite to the direction of movement of the long products $b_1$.

In order to optimally let the long products $b_1$ slide from the exit of the rolling mill 100 to the cooling bed 5 while being effectively braked, without directly contacting the components of the braking system according to the present invention, it is preferable to arrange the at least one braking module 6 by aligning the gaps formed by the two opposed poles of each electromagnet 60 in order to form a contactless passageway for the long products $b_1$.

In one preferred embodiment, the method according to the present invention comprises the step of disposing electromagnets 6 in a staggered array along a braking line 1*b* according to a first row and to a second row so as to form an alternate arrangement along the braking line 1*b*. The contactless passage of the long products through the gaps of the series of electromagnets 60 is thus guaranteed by offsetting from each other the electromagnets 60 of respectively the first and the second row in a direction transverse to the braking line 1*b*. Arranging the electromagnets as described results in having all of the gaps formed by the two opposed poles of each electromagnet 60 lined up to form a contactless passageway for the long products $b_1$.

The method according to the present invention acts by exercising on the long products $b_1$ an overall braking magnetic force, or drag force, Fd. The force Fd is substantially proportional to the sum of the braking magnetic force developed by each of the electromagnets 6.

The method according to the present invention can comprise the step of arranging a multiplicity of braking modules 6 in series with respect to each other along the braking line 1*b*, especially in consideration of the dimensions and of the weight of the long products to be handled, braked and delivered to the cooling bed 5. Such a configuration is for instance represented in FIG. 5. The respective electromagnets 60 are disposed so that the contactless passage of the long products $b_1$ is enabled along the braking line 1*b* through the succession of both:

the gaps of the series of electromagnets 60 within one same braking module 6; and the gaps, or spaces, between successive braking modules 6.

The method and the system according to the present invention effectively generates the required braking force Fd for decelerating long products, such as bars $b_1$, exiting a rolling mill 100 by inducing eddy currents in the long products.

By adopting the solution according to the present invention, no contact between bars, or long products in general, and components of the braking system is actually needed. Thus, the main drawback of a traditional braking system is overcome, in that the present invention ensures that no deformation of the products of the long rolling process occurs.

The present invention allows efficient braking of rolled product after their rolling, as well as the cutting of the product to length and discharging it onto cooling beds. The order of magnitude of the time employed for carrying out a braking cycle is radically improved. For instance, the present invention allows reducing the braking cycle time lapse from the at least 1 second needed by current technologies to just 100 milliseconds. Such a drastic reduction of the required braking cycle time entails a proportionally enhanced ability of the braking system to cope with a large range of long rolling rates and production settings. Current limitations in production cycles can be overcome, because a braking system according to the present invention is much more versatile and compliant to wide-ranging working conditions of the rolling mill plant and of the correlated cooling beds from which the long products are taken to packing or to further processing stations.

By employing a fully electromagnetic, eddy current-induced braking system according to the present invention, with no moving or contact parts and no rotating rolls, as opposed to the current electromechanical systems. Maintenance costs are advantageously reduced, since no parts liable to wearing are present. Due to the fact that there are no rotating parts, bearings and lubrication devices are advantageously superfluous.

Thanks to the braking system and the related contactlessly decelerating method according to the present invention, the installation space required for the braking of long rolled products will be reduced due to the elimination of motors and of the mechanical connections between such motors and conventional pinch rolls.

Moreover, by waiving the use of energy-inefficient electro-mechanical actuators currently in use (such as pinch rolls needing to be connected to AC or DC motors and moved by pneumatic cylinders), a substantial, saving in energy consumption is achieved. Accordingly, the preset solution dispenses with the adverse impact on the environment of currently employed technologies.

The invention claimed is:

1. An eddy current contactless braking system for decelerating metal products exiting a rolling mill that is configured to manufacture the products, the system comprising:

at least one braking module comprising a plurality of electromagnets arranged in a series along a braking line, each of the electromagnets being configured to induce a magnetic field and comprising an open magnetic core and a coil around the magnetic core, wherein each open magnetic core comprises a gap formed by two opposed poles between which the magnetic field flows, the electromagnets of the braking module are configured such that the gap of each open magnetic core is located and sized to receive and let contactlessly slide therethrough each metal product exiting the rolling mill and such that a magnetic braking force is exercised on the metal product by the electromagnets when the metal product contactlessly slides through the gap, wherein the braking magnetic force is opposite to a direction of movement of the metal product exiting the rolling mill;

for the braking module the electromagnets are disposed in a staggered array along the braking line in an alternating arrangement of a first row and a second row to form an alternating arrangement with each other along the braking line, wherein the electromagnets of the first row and the electromagnets of the second row are offset from each other in a direction transverse to the braking line in a configuration wherein all of the gaps formed by the two opposed poles of each magnetic core are lined up for enabling the contactless passage of a metal product through the gaps of the series of electromagnets.

2. The contactless braking system of claim 1, wherein the open magnetic core of each electromagnet is C-shaped or generally yoke-shaped and the magnetic field loops on the core across the gap.

3. The contactless braking system of claim 1, further comprising a plurality of the braking modules arranged in a series with respect to each other along the braking line in a configuration that enables the contactless and substantially continuous passage of the metal products through the gaps of the electromagnets of subsequent braking modules; and wherein the braking line is positioned between the exit of a rolling mill and a cooling bed for the metal product.

4. The contactless braking system of claim 1 further comprising the plurality of the electromagnets comprises a range of 20 to 400 of electromagnets arranged in a series.

5. The contactless braking system of claim 1, wherein the gap between the opposed poles of the open magnetic core is 10 to 60 millimeters.

6. The contactless braking system of claim 1, wherein each pole of the magnetic cores has an active surface area comprised in a range of 60 to 1000 square millimeters.

7. The contactless braking system of claim 1, wherein the plurality of electromagnets in the series along the braking line are configured and selected such that when the electromagnets induce a magnetic field, each of the metal products that is being braked is braked when the metal products are long enough to be contactlessly braked.

8. The contactless braking system of claim 7, wherein each long metal product is more than one meter in length as it enters the gap.

9. A method of contactlessly decelerating metal products, exiting a rolling mill, wherein the mill is configured to manufacture the metal products, the method comprising the steps of:

arranging a braking module comprising a plurality of electromagnets in a series along a braking line, wherein the braking line is positioned between the exit of a rolling mill and a cooling bed for the metal products, wherein each of the electromagnets comprises an open magnetic core and a coil around the magnetic core, the open magnetic core comprising a gap formed by two opposed poles of each of the electromagnets;

inducing by each of the electromagnets a magnetic field flowing across the gap;

feeding the metal products exiting rolling mill to the braking module by letting the metal products contactlessly slide through each of the gaps of respective open magnetic cores;

exerting a braking magnetic force on the metal products by the electromagnets while the metal products contactlessly slide through the gaps, while exerting the braking magnetic force opposite to the direction of movement of the metal products;

arranging at least the braking module comprising a plurality of the electromagnets in a series along a braking line comprising the steps of:

disposing the electromagnets in a staggered array along the braking line in a first row and a second row arranged to form an alternating arrangement along the braking line;

the arrangement enabling the contactless passage of the metal products through the gaps of the series of electromagnets by offsetting from each other the electromagnets of respectively the first and the second rows in a direction transverse to the braking line such that all of the gaps formed by the two opposed poles of each electromagnet are arranged to form a contactless passageway for the long products; and applying on the metal products an overall braking magnetic force that is the sum of the braking magnetic forces developed by each of the electromagnets.

10. The method of claim 9, wherein the arranging of at least a braking module comprise arranging a plurality of the electromagnets in a series along a braking line which comprise the step of aligning the gaps formed by the two opposed poles of each the electromagnets in order to form a contactless passageway for the metal products.

11. The method of claim 9, further comprising:

arranging a plurality of the braking modules in series with respect to each other along the braking line, while disposing the respective electromagnets of the modules so that the contactless passage of the metal products through the succession of gaps of the series of electromagnets within one braking module and between the modules of the series of successive braking modules along the braking line is enabled.

12. The method of claim 9, further comprising the rolling mill is configured to manufacture long metal products of a length, in a direction toward an exit from the rolling mill, such that each long metal product is long enough to be braked by the contactless braking as the long metal product contactlessly slides through the gap.

13. The method of claim 12, wherein the long metal product is more than one meter in length as it enters the gap.

* * * * *